United States Patent [19]

Carver

[11] Patent Number: 4,537,435

[45] Date of Patent: Aug. 27, 1985

[54] DOWNHOLE RETRIEVAL TOOL

[76] Inventor: Herman C. Carver, 1105A Sequoia, Bakersfield, Calif. 93308

[21] Appl. No.: 593,942

[22] Filed: Mar. 27, 1984

[51] Int. Cl.[3] ..... E21B 31/12

[52] U.S. Cl. ..... 294/86.1; 294/86.2; 294/86.27

[58] Field of Search ..... 294/86 R, 86.1, 86.12, 294/86.14, 86.17–86.2, 86.24, 86.25, 86.27, 103 R, 120, 126

[56] References Cited

U.S. PATENT DOCUMENTS

| | | | |
|---|---|---|---|
| 776,425 | 11/1904 | Riggs | 294/86.24 |
| 1,418,533 | 6/1922 | Carter et al. | 294/86.24 X |
| 1,790,387 | 1/1931 | Monroe | 294/86.1 |
| 3,029,098 | 4/1962 | Sonnier | 294/86.1 |
| 4,353,585 | 10/1982 | Carver | 294/86.1 |
| 4,397,494 | 8/1983 | Carver | 294/86.1 |

*Primary Examiner*—Johnny D. Cherry
*Attorney, Agent, or Firm*—Donald D. Mon

[57] ABSTRACT

A downhole retrieval tool to recover lost wire or cable from a well. The tool has an elongated body with a smooth outer wall. A notch is formed in the wall to receive a wire to be retrieved. Within the body and operable in the notch is a latch member to trap the wire, and a trip member to release the latch member for that purpose when a wire is inside the notch.

7 Claims, 3 Drawing Figures

DOWNHOLE RETRIEVAL TOOL

FIELD OF THE INVENTION

This invention relates to a tool to be sent downhole in a well to retrieve a lost wire.

BACKGROUND OF THE INVENTION

The subject of retrieving wires or cables which are lost in a well has been much developed because of the substantial economic consequences. A well from which a wire cannot be recovered can be totally incapacitated. To recover the wire takes time and skill, and involves lost production and costly labor and equipment rental. It is not surprising, therefore, that many "fishing" tools for this purpose have been developed. What is perhaps surprising is that after so many years, even the best of these tools has important shortcomings. It is an object of this invention to provide an improved tool that overcomes at least some of these shortcomings.

For example, when a wire (a cable is sometimes herein referred to as a wire) is lost downhole, it generally packs in as a tangled, snarled mess. To grab this cable, one must either work on its upper end and engage it with some device at the lower end of the tool, or penetrate the snarl, and engage it with some device on the wall of the tool. Because wires and cables are relatively thin, and in the snarl are convoluted, fishing at the upper end of the snarl involves a great deal of luck. Luck is not a valid criterion for equipment design.

Tools have been designed which penetrate the snarl. Two examples are Carver U.S. Pat. Nos. 4,353,585 and 4,397,494. These tools have a body with an outer wall, which body is caused to penetrate the snarl. Edges project beyond the outer wall, and they are tripped by contact with the wire so as to retract toward the body and to grab and hold the wire so that it can be pulled up with the body. These useful tools suffer from the disadvantages that the catches can impede the passage of the body into the snarl, and that the retentive forces holding the wire to the tool are limited by the strength of the catch. It is an object of this invention to provide a retrieval tool which does not suffer from these disadvantages.

BRIEF DESCRIPTION OF THE INVENTION

A retrieval tool according to this invention has an elongated body with an axis, and a smooth axially extending peripheral wall. A notch in the wall has dimensions adequate to receive the cross-section of a wire to be retrieved, the notch being bounded by a solid wall at its downhole edge. The cross-section of the wire enters the notch for retrieval, and when it does enter is held there by a latch member.

The latch member is axially slidably fitted in the body and is adapted to be moved toward and away from the solid wall. It has a trap face which faces toward that wall. Latch biasing means exerts a bias force on the latch member tending to move it toward the wall. A trip member is axially slidably fitted in the body and the trip member is adapted to be moved out of the notch by the wire so as to trip the latch and enable it to move to trap the wire in the notch.

The above and other features of this invention will be fully understood from the following detailed description and the accompanying drawings in which.

DETAILED DESCRIPTION OF THE INVENTION

Figure 1:
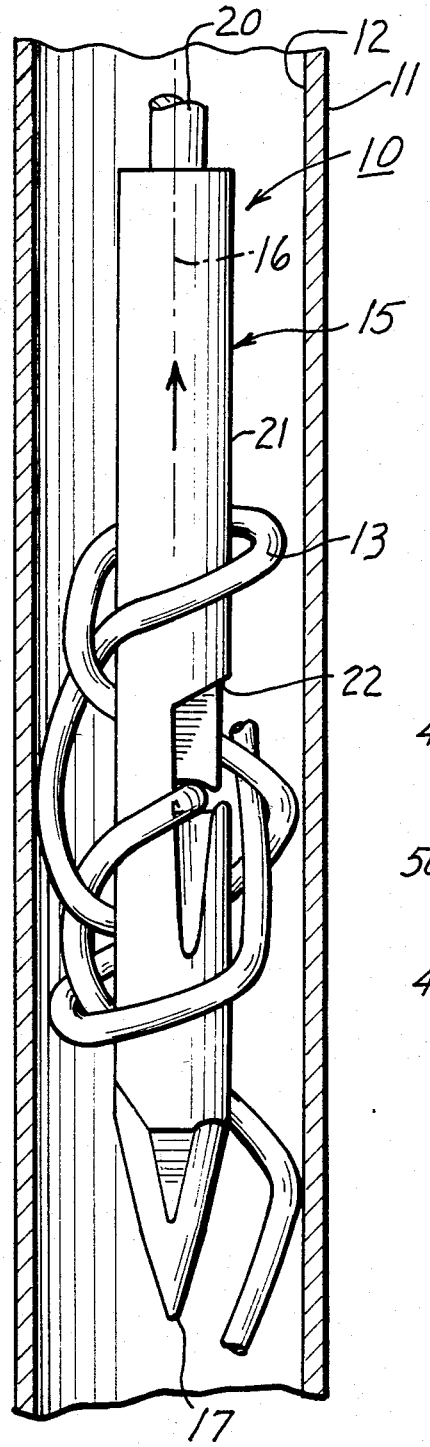
FIG. 1 shows the tool engaged with a wire to pull it to the surface.

A retrieval tool 10 according to the invention is shown inside the casing 11 of a well going down the "hole" 12. Within this hole there is a length of wire 13 (the term wire also including the term cable) which is loose, and which is to be retrieved. It is of indefinite length and it is the object of the tool to grasp the wire and pull it to the surface.

The tool has an elongated body 15 having a central axis 16 and a pointed downhole end 17. The tool may be generally cylindrical or prismatic. The point assists the tool to penetrate a tangled snarl of wire.

The tool is supported by a rod or cable 20 by means of which it is lowered into the well. It has a substantial weight which is usually sufficient for it to penetrate the mass although it could instead be dropped from a substantial distance to assist in penetration. Less desirably, it could be mounted on a rod and forced down.

The body has a smooth, axially extending outer wall 21 so that wire can slide along it and the device is not likely to hang up except on means yet to be described.

Figure 2:
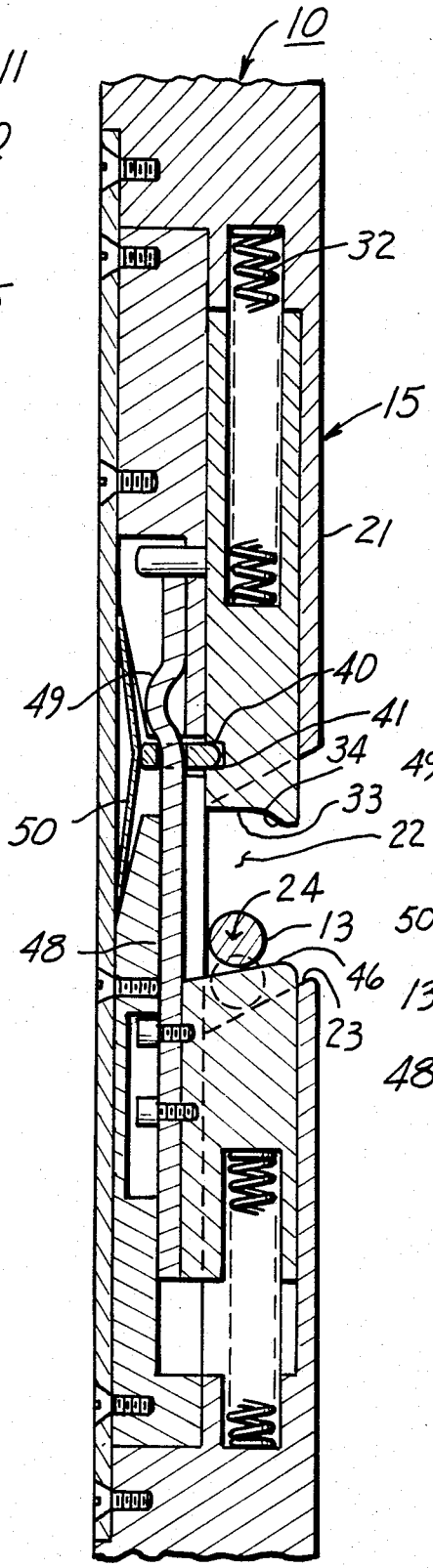
FIG. 2 shows the tool in its cocked position about to be released by contact with a wire.
Figure 3:
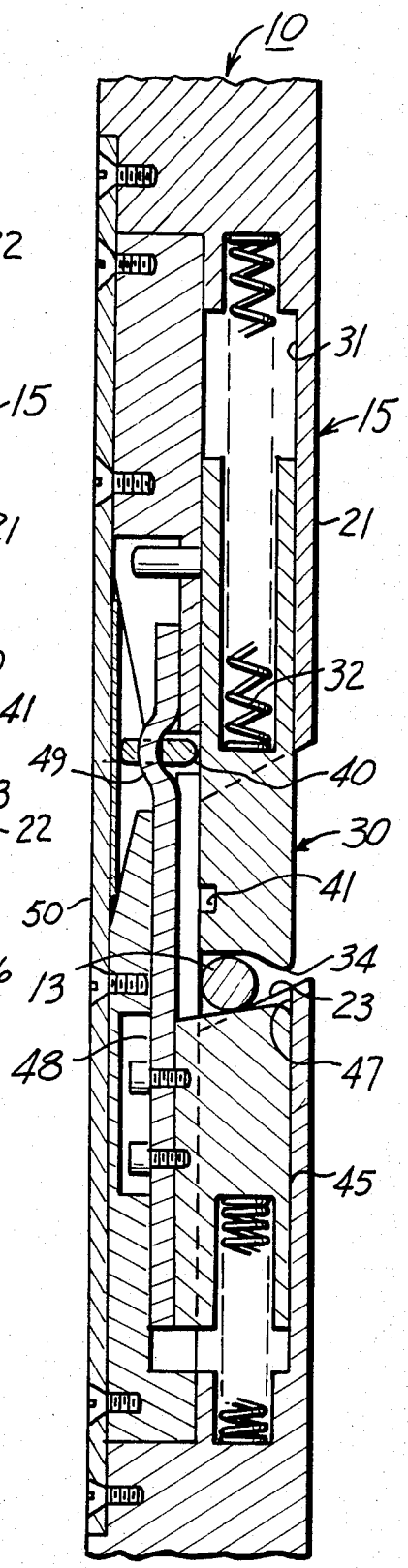
FIG. 3 is an enlarged detail of FIG. 1, showing the wire grasped by the tool.

The wall of the body has a notch 22. The notch has a downhole wall 23 which slopes inwardly and toward the downhole end of the tool. It is the object of this invention to catch the wire in this notch and bring it to the surface. The dimensions of the notch are such as to accommodate the cross-section 24 of the wire, as best shown in FIGS. 2 and 3.

The body is preferably mostly solid to give it weight, but has within it a cavity sufficient to accommodate the elements next to be described.

A latch member 30 is slidably fitted in a slot 31 in the body at the up-hole end of the notch. It is biased by bias spring 32 toward the downhole end wall of the notch. It has a trap face 33 with a depending lip 34 to assist trapping the wire once it is caught. As can best be seen in FIGS. 2 and 3, the latch member is initially maintained in an upper position, mostly out of the notch, against the bias of bias spring 32. It is held in this position by a catch member 40 which can engage in a detent 41 in the latch member in one position shown in FIG. 2, and which can be withdrawn from it in the position shown in FIG. 3. The condition of the catch member is defined by a trip member 45.

The trip member is adapted to move into and out of the notch. It has a trip face 46 facing upwardly into the notch located so as to be engaged by the wire when the wire enters the notch. The trip member is axially slidable in a slot 47 in the body and has an extension 48 which extends upwardly toward the latch member and the catch member. A joggle 49 in the extension is displaced from the catch member in the cocked position shown in FIG. 2 and the extension causes the catch member to move to enter into the detent. When the wire forces the trip member downwardly as shown in FIG. 3 it pulls the extension with it and the joggle falls beneath the catch member and enables the catch member to move out of the detent to release the latch member to trap the wire.

A load spring 50 biases the catch member toward the latch member and it is the positive movement caused by the joggle 49 that retracts the load spring along with the catch member.

The operation of the device should be evident from the foregoing. It is lowered or dropped into the well in the configuration shown in FIG. 2 which is called the cocked configuration. When the wire enters the notch nothing initially happens until it moves to the dotted line position shown in FIG. 2 which is the solid line position shown in FIG. 3. At that time an upward pull on the tool, or sufficient weight of the wire, will cause the trip member to move downward relative to the wall, pulling its extension down and releasing the catch and thereby releasing the latch member. The latch member springs against the wire and traps it against wall 23 thereby holding the wire in the body in such a way that a lift on the body assuredly brings the wire to the surface.

This device is at once elegantly simple and reliable. It enables a smooth outer wall to be utilized for the body so that there is less risk of hangup of the tool on any object. Because of the tangled configuration of the wire it is almost certain that at some point the wire will enter the notch and be caught. More than one notch may be placed either in line with one another or at various angles around the body in order to give greater redundancy to the operation of the device.

This invention is not to be limited by the embodiment shown in the drawings and described in the description which is given by way of example and not of limitation, but only in accordance with the scope of the appended claims.

I claim:

1. A retrieval tool for retrieving wires lost downhole, said tool comprising:

an elongated body having an axis, a smooth axially extending peripheral wall, and a notch in said wall having dimensions adequate to receive the cross-section of a wire to be retrieved, said notch being bounded by a wall at its downhole edge;

a latch member axially slidably fitted in said body, which latch member is adapted to be moved toward and away from said wall, and having a trap face which faces toward said wall;

latch bias means exerting bias force on said latch member tending to move it toward said wall;

a trip member axially slidably fitted in said body, said trip member being adapted to move into and out of said notch and having a trip face facing away from said wall; and a catch member interposed between said body and said latch member adapted to hold said latch member away from said wall until said catch member is enabled to be moved by said trip member to enable the latch member to be moved toward said wall by its said bias means.

2. A retrieval tool according to claim 1 in which said wall slopes inwardly, and towards the downhole end of said tool.

3. A retrieval tool according to claim 2 in which said latch member includes an overhanging lip tending to trap the wire in said notch.

4. A retrieval tool according to claim 1 in which said trip member has an extension adapted to engage said catch member, and in which said latch member includes a detent adapted to be entered into by said catch member, the position of said catch member in or out of said detent being determined by the position of the trip member in or out of said notch.

5. A retrieval tool according to claim 4 in which said catch member is spring-biased towards said latch member.

6. A retrieval tool according to claim 4 in which said trip member is biased by bias means towards said notch.

7. A retrieval tool according to claim 1 in which the downhole end of said retrieval tool is pointed.

* * * * *